US007316460B2

(12) United States Patent
Takeo et al.

(10) Patent No.: US 7,316,460 B2
(45) Date of Patent: Jan. 8, 2008

(54) MAKEUP MIRROR UNIT

(75) Inventors: Hozumi Takeo, Fukuoka (JP); Kenichi Kubota, Fukuoka (JP); Saburo Minami, Osaka (JP); Takuji Minami, Osaka (JP)

(73) Assignee: Toto Ltd., Fukuoka (JP)

( * ) Notice: Subject to any disclaimer, the term of this patent is extended or adjusted under 35 U.S.C. 154(b) by 273 days.

(21) Appl. No.: 10/509,063

(22) PCT Filed: Mar. 25, 2003

(86) PCT No.: PCT/JP03/03645

§ 371 (c)(1),
(2), (4) Date: Mar. 29, 2005

(87) PCT Pub. No.: WO03/079865

PCT Pub. Date: Oct. 2, 2003

(65) Prior Publication Data

US 2005/0223487 A1 Oct. 13, 2005

(30) Foreign Application Priority Data

Mar. 25, 2002 (JP) ..... 2002-084206

(51) Int. Cl.
*A47B 67/00* (2006.01)
*A47B 1/00* (2006.01)

(52) U.S. Cl. ..... 312/227

(58) Field of Classification Search ..... 312/227, 312/224–226, 326, 329, 321.5, 228, 325; 49/149, 150, 152, 153, 246; 248/476, 479, 248/486; 359/871, 872

See application file for complete search history.

(56) References Cited

U.S. PATENT DOCUMENTS

| | | | | | |
|---|---|---|---|---|---|
| 1,006,481 | A | * | 10/1911 | Johnson | 312/225 |
| 1,088,765 | A | * | 3/1914 | Booth | 359/854 |
| 1,482,819 | A | * | 2/1924 | Simonson | 312/198 |
| 1,543,980 | A | * | 6/1925 | Blood | 312/290 |
| 2,763,186 | A | * | 9/1956 | Barlow | 359/854 |
| 2,878,091 | A | * | 3/1959 | Hammond | 312/209 |
| 3,140,134 | A | * | 7/1964 | Nairn | 312/204 |

(Continued)

FOREIGN PATENT DOCUMENTS

JP 54-36548 3/1979

(Continued)

*Primary Examiner*—Janet M. Wilkens
*Assistant Examiner*—Timothy M Ayres
(74) *Attorney, Agent, or Firm*—Birch, Stewart, Kolasch & Birch, LLP

(57) ABSTRACT

A makeup mirror unit includes a pair of sub mirrors and a pair of rack portions. In order to take goods from the rack portions, the sub mirrors are rotated inwardly around shafts of first hinges. In order to match the sub mirrors together, the sub mirrors are rotated toward the front side together with the frames around shafts of second hinges which are attached opposite with respect to the first hinges. When the left and right sub mirrors are opened, and the side ends of the sub mirrors are adjacent with respect to each other in a state where the left and right sub mirrors are positioned in the front center portion of the makeup mirror unit, by connecting the magnet and the magnet receiver to each other, the sub mirrors can easily be connected in the center to be in the same plane.

10 Claims, 6 Drawing Sheets

U.S. PATENT DOCUMENTS

| | | | | | |
|---|---|---|---|---|---|
| 3,771,854 | A | * | 11/1973 | Roark | 359/854 |
| 3,909,091 | A | * | 9/1975 | Tantillo | 312/224 |
| 4,396,249 | A | * | 8/1983 | Aisley | 359/854 |
| 4,775,231 | A | * | 10/1988 | Granzow et al. | 359/860 |
| 5,399,008 | A | * | 3/1995 | Vann, Jr. | 312/227 |
| D403,907 | S | * | 1/1999 | Kato | D6/559 |
| 6,382,746 | B1 | * | 5/2002 | Rosas | 312/227 |
| 6,565,220 | B1 | * | 5/2003 | Hayward | 359/872 |
| 6,926,416 | B2 | * | 8/2005 | Sawyer | 359/855 |

FOREIGN PATENT DOCUMENTS

| | | | |
|---|---|---|---|
| JP | 57-125705 | A | 8/1982 |
| JP | 58-12615 | A | 1/1983 |
| JP | 58-110174 | U | 7/1983 |
| JP | 62-79447 | U | 5/1987 |
| JP | 4-83031 | U | 7/1992 |
| JP | 5-42054 | A | 2/1993 |
| JP | 5-37150 | U | 5/1993 |
| JP | 5-41433 | U | 6/1993 |
| JP | 3055242 | U | 1/1999 |
| JP | 2000-254021 | A | 9/2000 |

* cited by examiner

MAKEUP MIRROR UNIT

TECHNICAL FIELD

The present invention relates to a makeup mirror unit which is installed in the upper portion of a wash and makeup stand.

BACKGROUND ART

A makeup mirror unit comprising triple mirrors installed in the upper portion of a wash and makeup stand has been well-known. When a woman puts on her makeup such as eyeliner which requires precision, a man shaves, or a person puts in contact lenses by means of such a makeup mirror unit, it is necessary to move his or her face close to the mirror. This is especially true and more necessary when a person who uses glasses takes their glasses off to wash his or her face.

Document 1, document 2, and document 3 disclose a means for solving the problem that a user is forced to keep an uncomfortable position for a long period of time as mentioned above.

Document 1 discloses a structure comprising a front mirror (main mirror) provided in the center of a cabinet, side mirrors (sub mirrors) provided in both sides of the cabinet, and racks provided also in both sides to be covered by the side mirrors, in which a support frame is fixed so as to freely rotate by a hinge, and the side mirror is fixed to the support frame so as to freely rotate by another hinge. In this structure, when a user takes makeup goods or the like from the rack, the user rotates the side mirror outward together with the support frame. When a user uses this as triple mirrors, the user rotates only the side mirror inward.

Document 2 discloses a similar structure to document 1. However, in document 2, a sheet-like door is employed instead of a frame, and a rack for small goods is provided inside the door.

Document 3 discloses a structure in which auxiliary mirrors are provided at both sides of a main mirror, so as to freely rotate, and a shelf which uses the auxiliary mirror as a lid body is provided in a back panel (cabinet). Document 3 also discloses a structure in which a guide (arm) is further provided between the auxiliary mirror and the back panel so as to allow the auxiliary mirror to be further extended toward a user.

Document 4 and document 5 have been known as a conventional art material which has the same effect as a case where a main mirror moves forward.

In document 4, a support arm is fixed to a makeup stand frame (cabinet) so as to freely rotate, and an auxiliary mirror is fixed to the support arm so as to freely rotate, so that a user can move the auxiliary mirror very close to him/herself.

In document 5, a pantograph mechanism is used, so that a user can move a front mirror close to him/herself.

(Document)

Document 1: Japanese utility model application publication No. 54-36548

Document 2: Japanese utility model application publication No. 62-79447

Document 3: Japanese utility model application publication No. 5-37150

Document 4: Japanese patent application publication No. 57-125705

Document 5: Japanese patent application publication No. 2000-254021

According to documents 1-3, it is possible to rotate the sub mirror close to a user. However, the sub mirror can come close to a user only from the side, and the sub mirror cannot be positioned in front of the main mirror. Therefore, when a user puts on precise makeup or shaves, the user has to keep an unnatural state of turning the user's head or body, which is uncomfortable.

Also, according to documents 4 and 5, a user can put on makeup or the like by moving the mirror close to the user without turning the user's body. However, since the support arm is long in document 4, when a user uses the mirror by moving the mirror close to him/herself, the user has to change where he/she stands, and it becomes difficult to use a washbowl.

In document 5, it is possible to surely move the mirror forward. However, since the pantograph mechanism is provided in the backside, it is impossible to effectively utilize the space of the backside.

DISCLOSURE OF THE INVENTION

In order to solve the above-mentioned problems, a makeup mirror unit according to the present invention is comprised of a cabinet body, a main mirror provided in a substantially central portion of the front surface of the cabinet body, a rack portion provided at least in one side of the main mirror, and a sub mirror which covers the rack portion, wherein a frame is fixed in a portion of the front surface of the rack portion, which is near to the main mirror, so as to freely rotate in a horizontal direction, and the sub mirror is fixed to the outer end of the frame so as to freely rotate in a horizontal direction.

With this structure, it is possible to move the sub mirror in front of and very close to a user without causing the user's position to change.

As the shape of the frame, it is possible to use a C shape comprising a vertical member, an upper horizontal member and a lower horizontal member. In this instance, it is preferable to position the vertical member at the end which is near to the rotation center of the sub mirror, in other words, which is remote from the rotation center of the frame. With this positioning, an opening area becomes large when cosmetics or the like are taken from the rack portion, so that user-friendliness can be improved. In addition, when the sub mirror is closed, the vertical member becomes positioned in the vertical portion outside the sub mirror, which can eliminate the gap in the side surface and prevent steam from entering the rack portion from the washbowl.

The shape of the frame is not limited to a C shape. It is also possible to use a box shape, or a shape comprising two bars except a vertical member of a C shape.

Regarding a hinge for fixing the frame to the cabinet body so as to freely rotate, it is preferable to locate the rotation axis of the hinge at a position of overlapping with the sub mirror in a closed state from a plan view or at a forward position thereto.

With this structure, it is possible to prevent the end surface of the sub mirror at the side of the main mirror from interfering with the end surface of the main mirror when the sub mirror is opened. It is also possible to place the sub mirror and the main mirror in the same plane when the sub mirror is closed. In addition, since the distance between the sub mirror and the main mirror can be reduced, the appearance can be improved by having only a small gap between the mirrors.

It is possible to clamp a seat of a hinge for fixing the frame and the sub mirror to a back surface of the frame, and clamp the other seat for the hinge to a back surface of the sub mirror.

With this structure, the appearance becomes good because the seats for the hinge can be prevented from being exposed even in a case where the sub mirror is opened.

It is also possible to integrally form the seat of the hinge for fixing the frame and the sub mirror together with the frame, and integrally form a seat of the hinge for fixing the frame to the cabinet body together with the frame.

With this structure, since the number of the components is reduced, the cost can be reduced, and good appearance can also be achieved.

The sub mirror may be provided at both sides of the main mirror. In this instance, it is possible to provide a simple coupling member for coupling the sub mirrors to each other, such as a magnet, a sheet fastener, a hook or the like, in the ends of the sub mirrors near to the main mirror.

With this structure, the sub mirrors can be coupled easily in the central portion so as to be in the same plane, and the user-friendliness can be improved.

A rack portion for small goods may be provided in the back surface of the sub mirror, which utilizes the thickness of the frame. If the thickness of the frame is increased, not only the rigidity can be increased, but also the thickness can be utilized as a rack portion. There are cases where a rack portion can be formed without recessing the back surface of the sub mirror.

BEST MODE FOR CARRYING OUT THE INVENTION

Figure 1:
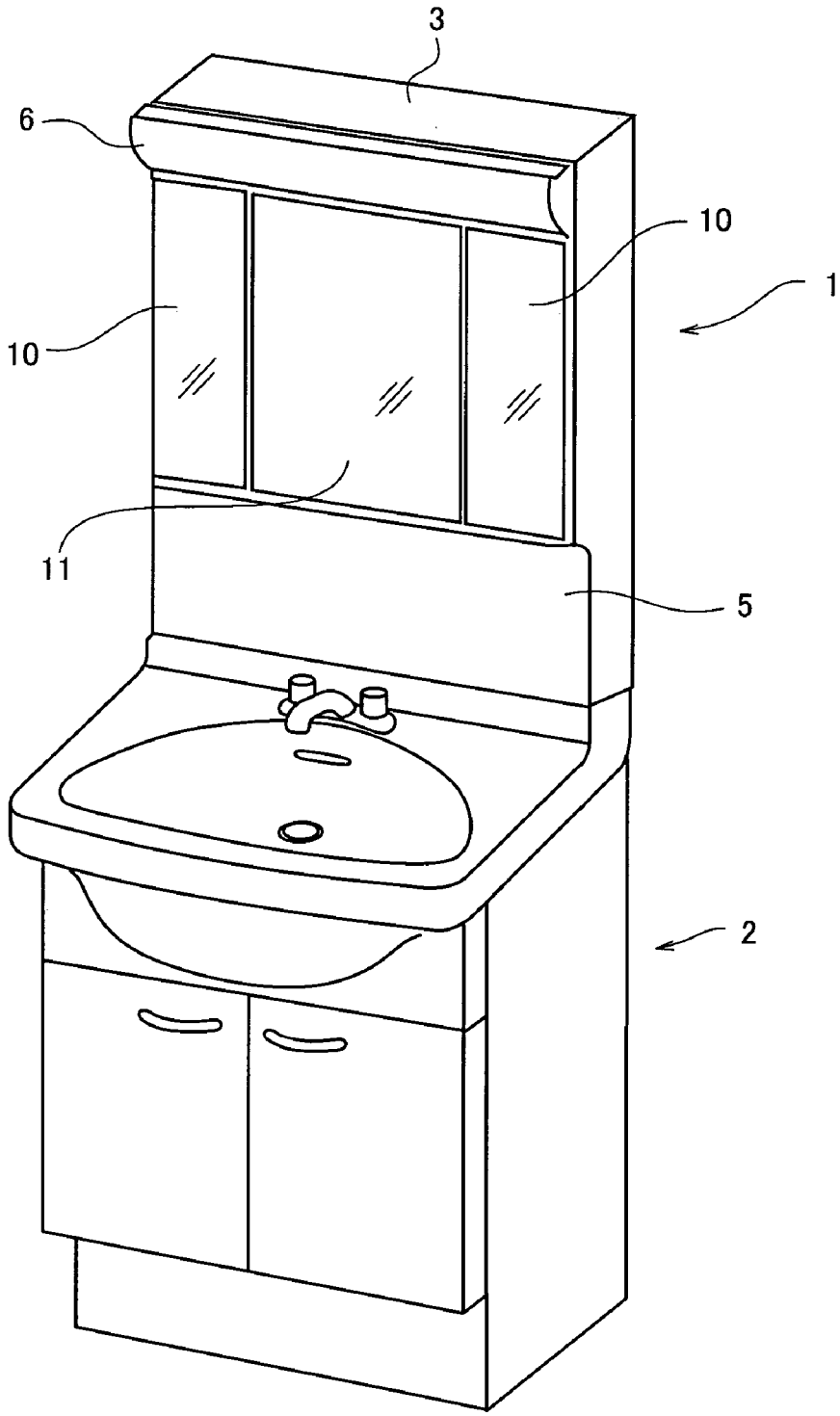
FIG. 1 is a perspective view of an embodiment using the present invention.
Figure 2:
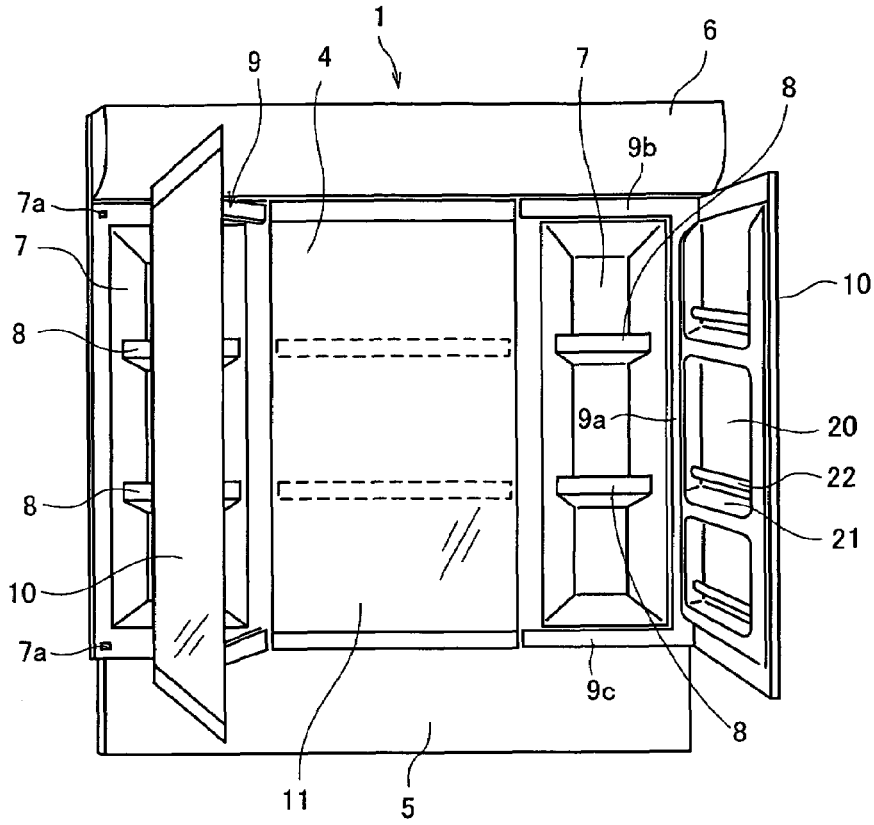
FIG. 2 is a perspective view showing an embodiment of a makeup mirror unit according to the present invention.
Figure 3:
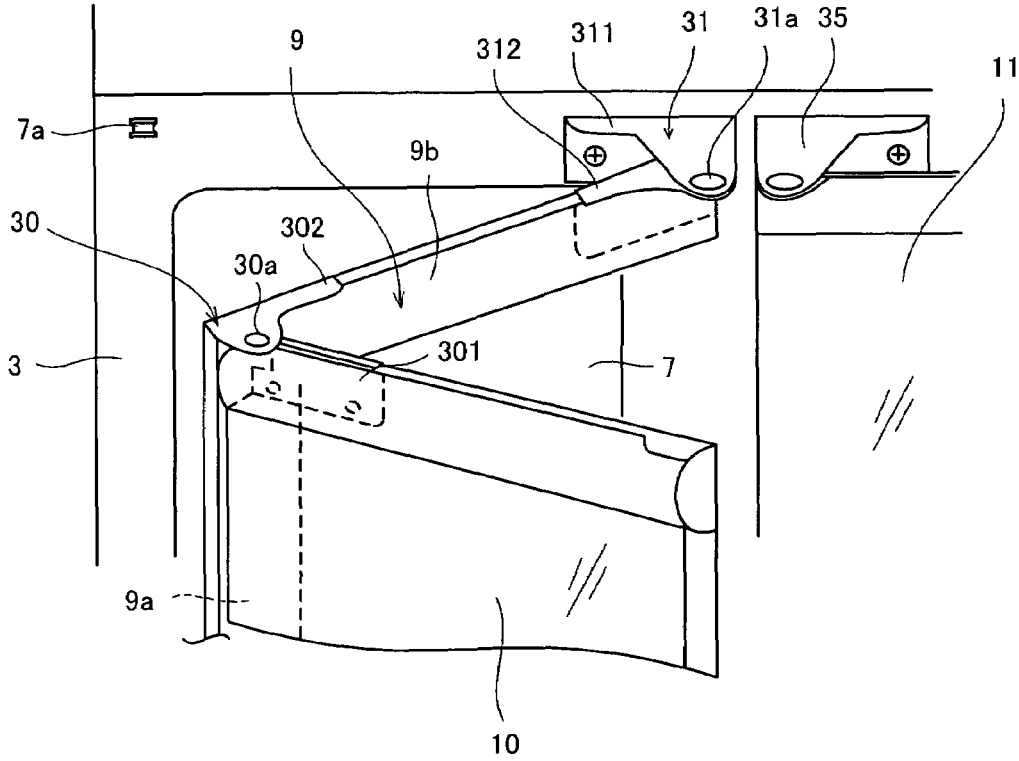
FIG. 3 is a detailed view showing an embodiment of a hinge according to the present invention.
Figure 4A:
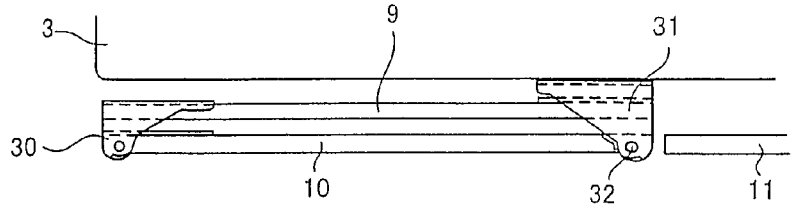
FIGS. 4(*a*)-(*c*) show movement of the makeup mirror in the present invention.
Figure 4B:
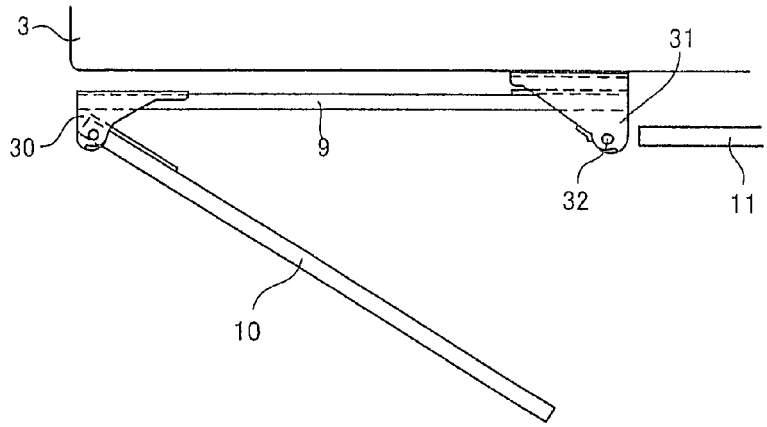
Figure 4C:
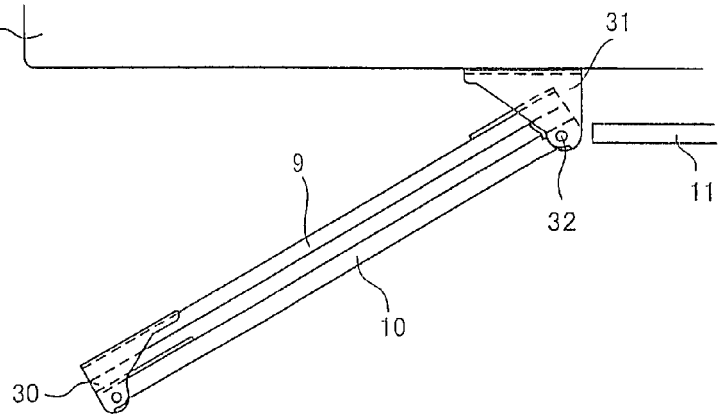

Embodiments of the present invention will now be described with reference to the attached drawings. FIG. 1 is a perspective view of an embodiment using the present invention, FIG. 2 is a perspective view showing an embodiment of a makeup mirror unit according to the present invention, FIG. 3 is a detailed view showing an embodiment of a hinge according to the present invention, and FIG. 4 shows movement of the makeup mirror in the present invention.

A makeup mirror unit 1 is to be installed in an upper portion of a washstand 2, and comprises a cabinet body which is integrally formed by using resin. A rack portion is provided inside the cabinet body 3. A main mirror 11 is fixed to the front surface of the cabinet body 3 via a hinge 35 (shown in FIG. 3) so as to freely rotate, sub mirrors 10 and 10 are provided at both sides of the main mirror 11, and a lighting means 6 is installed in the upper end of the cabinet body 3.

In this regard, the width of the sub mirror 10 is ½-⅔ of the main mirror 11. In the case where the width of the sub mirror 10 is ½ of the main mirror 11, when both sub mirrors 10 are matched (shown in FIG. 5), the size of the matched sub mirrors 10 becomes the same as the main mirror 11, and the matched sub mirrors 10 creates the same state as if the main mirror 11 moves forward, so that the user-friendliness can be improved. In the case where the width of the sub mirror 10 is ⅔ of the main mirror 11, the area of the matched sub mirrors 10 becomes greater than that of the main mirror 11, so that the user-friendliness can be improved furthermore. However, since the width of the cabinet body 3 is limited to a predetermined one, if the width of the sub mirror 10 is too great, the width of the main mirror 11 needs to be reduced correspondingly. Therefore, ½-⅔ is preferable.

The rack portion which is provided inside the cabinet body 3 is comprised of a central rack portion 4, and left and right rack recess portions 7, 7 which are divided in a longitudinal direction. The main mirror 11 serves as an open-close door for the central rack portion 4. Removable shelf trays 8 are provided to form a plurality of stages.

A frame 9 is provided at the front surface of the rack recess portion 7. As shown in FIGS. 2 and 3, the frame 9 has a C shape which comprises a vertical member 9*a*, and upper and lower horizontal members 9*b* and 9*c*. The ends, which are near to the main mirror 11, of the horizontal members 9*b* and 9*c* are supported so as to freely rotate in a horizontal direction by a hinge 31 around a shaft 31*a*. The vertical member 9*a* is provided between the outer ends of the horizontal members 9*b* and 9*c*. The sub mirror 10 is supported at the outer ends of the horizontal members 9*b* and 9*c* where the vertical member 9*a* is provided, so as to freely rotate in a horizontal direction by a hinge 30 around a shaft 30*a*.

With this, by positioning the vertical member 9*a* in the end which is near to the rotation center of the sub mirror, in other words, by not positioning the vertical member 9*a* in the rotation center of the frame 9, the vertical member 9*a* can be prevented from being an obstacle when the sub mirror is opened and cosmetics are taken from the rack recess portion 7. In addition, when the sub mirror 10 is closed, the vertical member 9*a* blocks the gap between the sub mirror 10 and the cabinet body 3 so as to improve the appearance, and prevents steam from entering.

A rack portion for small goods 20 is provided in the back surface of the sub mirror 10. A shelf plate 21 is integrally formed in the rack portion for small goods 20, and a bar 22 for preventing goods from falling is attached in a slightly upper portion with respect to the shelf plate 21.

In the embodiment which is shown in the drawing, the rack portion for small goods 20 is formed by recessing the back surface of the sub mirror 10 forward. However, it is also possible to form the rack portion for small goods 20 by increasing the thickness of the frame 9 and utilizing the increased thickness. In this case, a shelf can be projected to the same extent as the thickness of the frame 9.

Also, as mentioned above, the sub mirror 10 is supported at the outer ends of the horizontal members 9*b* and 9*c* of the frame 9 so as to freely rotate in a horizontal direction by the hinge 30. The other ends (inner ends) of the frame 9 are supported at the cabinet body 3 so as to freely rotate in a horizontal direction by the hinge 31.

The frame 9 rotates around the end which is near to the main mirror 11 in a horizontal direction by the hinge 31.

The hinge 30 is comprised of seats 301 and 302, and the hinge 31 is comprised of seats 311 and 312. In the present embodiment, the seats 301 and 312 are fixed to the back surface of the frame 9 so as to be inconspicuous.

A magnet 7*a* can be provided in the front surface of the rack recess portion 7, specifically, in a position where the magnet 7*a* can face to the iron seat 302. With this structure, when a user wants to open the sub mirror 10 alone, the frame 9 can be prevented from being moved together, and the user-friendliness can be improved.

The rotation shaft 31*a* of the hinge 31 is located at a position which allows the rotation shaft 31*a* to overlap with the sub mirror 10 in a closed state from a plan view, or a forward position of the sub mirror 10. As a result, it is possible to prevent the rotation orbit of the end surface of the sub mirror 10 in the side of the main mirror 11 from reaching out to the side of the main mirror 11 beyond the end surface of the sub mirror 10 in the side of the main mirror 11 in a closed state. Since the sub mirror 10 can be installed without providing a gap or different stages between the sub mirror 10 and the main mirror 11, it is possible to achieve a structure of a makeup mirror having good appearance and user-friendliness.

The movement of the sub mirror 10 of the makeup mirror unit having the above-mentioned structure will now be explained.

First, in order to take goods from the rack portion 7 which is in a closed state as shown in FIG. 4(*a*), the sub mirror 10 is rotated inwardly around the shaft 30*a* of the hinge 30 as shown in FIG. 4(*b*). By doing so, a user can easily take out goods while keeping the same standing position in front of the makeup mirror unit 1.

Next, in order to use as a matched mirror, as shown in FIG. 4(*c*), the sub mirror 10 is rotated toward the front side together with the frame 9 around the shaft 31*a* of the hinge 31 which is attached to the opposite end to the hinge 30. By doing so, it is possible to use as a matched mirror.

Figure 5A:
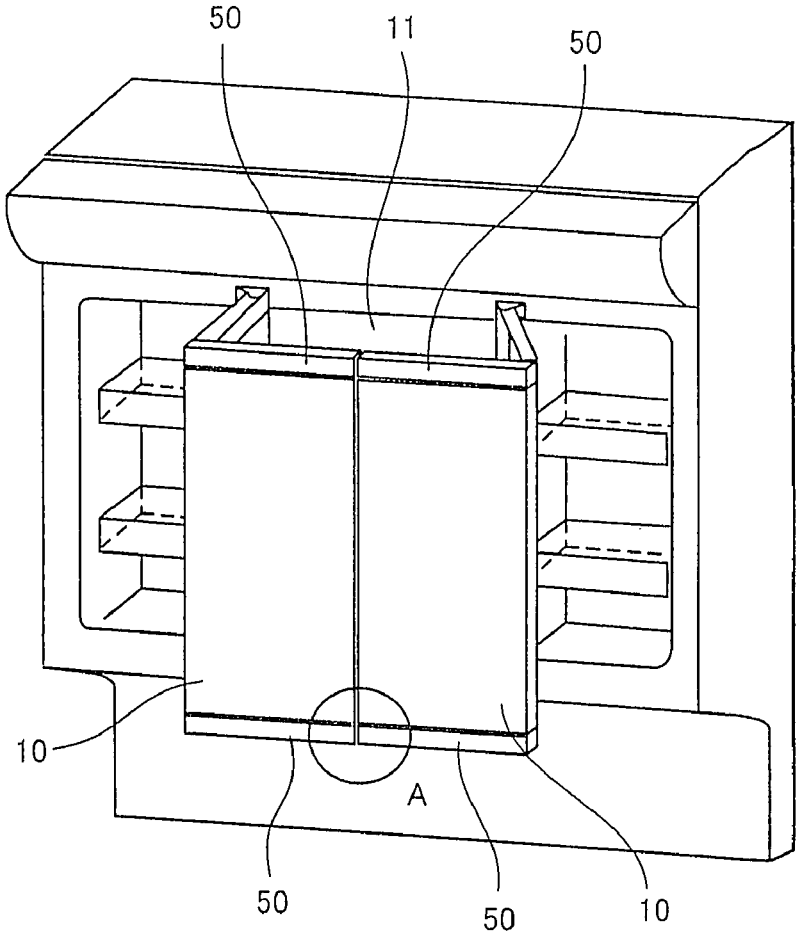
FIG. 5 is a detailed view showing another embodiment of the makeup mirror according to the present invention.
Figure 5B:
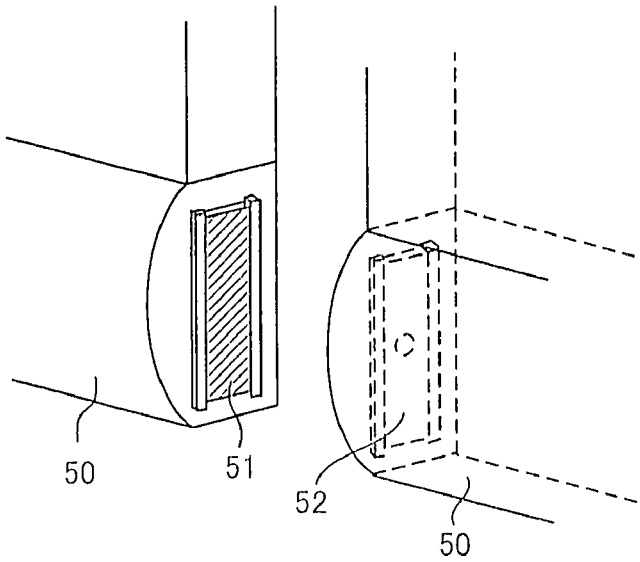

FIG. 5 shows another embodiment in which the left and right sub mirrors are connected in the center. Face rims 50 are attached to the upper and lower ends of the sub mirror 10. A magnet 51 and a magnet receiver 52 are imbedded in the side end of the rim face 50 which is in the side of the main mirror 11.

When the left and right sub mirrors 10, 10 are opened, and the side ends of the sub mirrors 10 are adjacent with respect to each other in a state where the left and right sub mirrors 10, 10 are positioned in the front center portion of the makeup mirror unit, the magnet 51 and the magnet receiver 52 are connected to each other. Consequently, the sub mirrors can easily be connected in the center to be in the same plane, so as to improve the user-friendliness.

Figure 6:
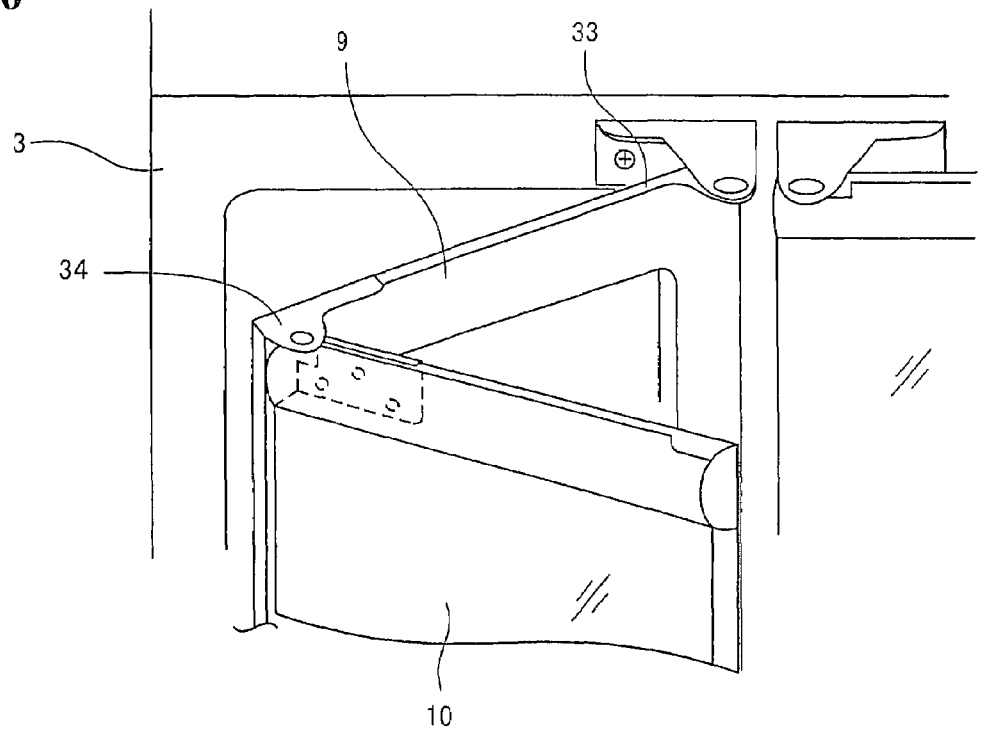
FIG. 6 is a detailed view showing another embodiment of the makeup mirror according to the present invention.

FIG. 6 shows a state where the hinge and the frame are integrally formed. In this case, the hinge 33 and the hinge 34 are integrally formed with the frame 9 in both ends thereof. The cabinet body 3 and the sub mirror 10 are fixed so as to freely rotate by the hinge 33 and the hinge 34, respectively.

Since the seat portions of the hinge 33 and the hinge 34 are integrally formed with both ends of the frame 9, the appearance at the time of opening the sub mirror 10 can be improved, and the cost can be reduced by decreasing the number of the components.

Figure 7A:
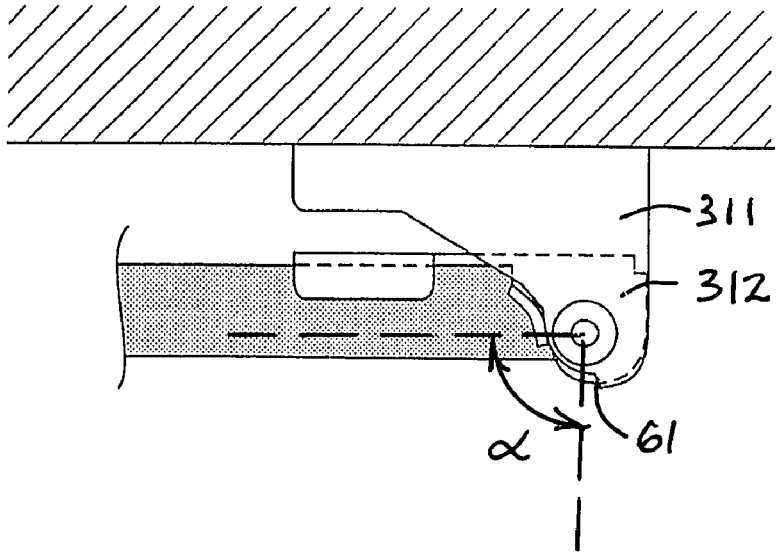
FIGS. 7(*a*) and (*b*) is a view showing another embodiment of the hinge according to the present invention.
Figure 7B:
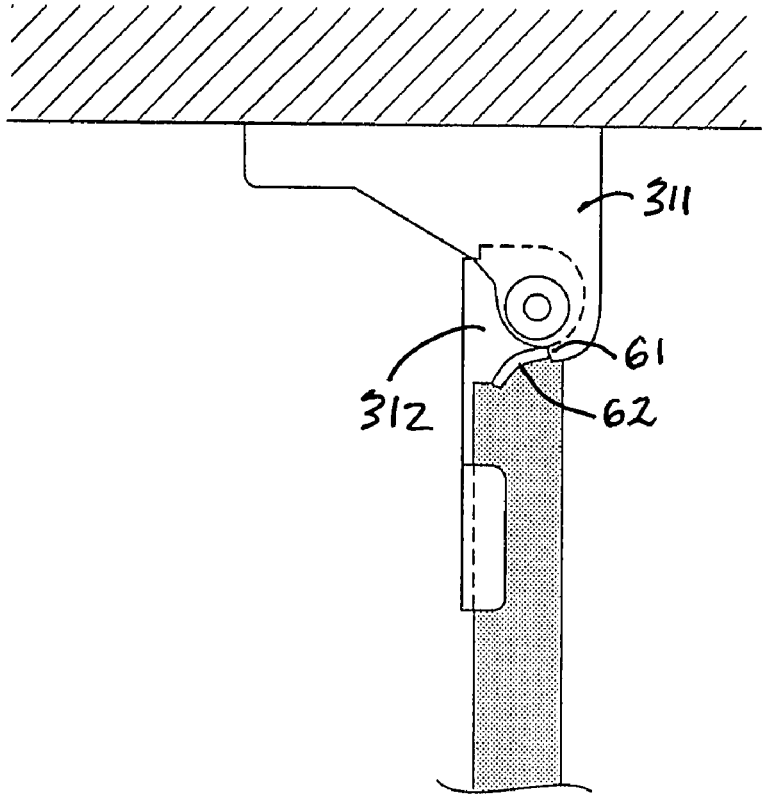

FIG. 7 shows another embodiment of the hinge 31 which connects the cabinet body 3 and the frame 9. In this embodiment, the hinge 31 is comprised of a member 311 which is in the side of the cabinet body and a member 312 which is in the side of the frame. The member 312 is supported so as to freely rotate with respect to the member 311 via the shaft 31*a*.

A notch 61 is formed in the member 311, and a stopper 62 is fixed to the member 312.

When the frame 9 is rotated around the shaft 31*a* from the closed state as shown in FIG. 7(*a*) to an opening direction, the notch 61 abuts against the stopper 62 as shown in FIG. 7(*b*), so as to stop being rotated further.

By limiting the rotation angle $\alpha$ of the frame 9 as mentioned above, it is possible to prevent the sub mirror 10 from moving toward the main mirror 11 farther than needed, and also prevent the main mirror 11 from being damaging by the back surface of the sub mirror. 10 Accordingly, a user can move the sub mirror 10 in front of the main mirror 11 comfortably.

Incidentally, in the embodiment shown in the drawings, there are provided two sub mirrors right and left. However, only one mirror may be provided in one side.

INDUSTRIAL APPLICABILITY

According to the present invention, a user can use a mirror widely in the center of a wash and makeup stand by locating the sub mirror in a front and substantially central position of a makeup mirror unit in a state where the sub mirror is opened forward.

Also, a user can move the sub mirror toward his/her face without changing his/her position. Therefore, even when a user takes cosmetics from the rack portions for small goods provided at the left and right, the user has only to slightly shift his/her line of the sight without changing the height of his/her line of sight. Consequently, it is extremely easy to use.

The invention claimed is:

1. A makeup mirror unit in combination with a wash and makeup stand comprising:

a cabinet body installed in the upper portion of the wash and makeup stand;

a left sub mirror provided to substantially cover an outer left portion of a front surface of said cabinet body;

a main mirror is provided to substantially cover a central portion of the front surface of said cabinet body;

a right sub mirror provided to substantially cover an outer right portion of the front surface of said cabinet body;

a left frame having a left side pivotally fixed to an outer left edge of the left sub mirror and having a right side pivotally fixed with a limited rotation angle to a portion of the cabinet adjacent to the main mirror so that the left frame and the left sub mirror are able to freely rotate in a horizontal direction providing a fully open state when said left sub mirror is facing outwardly in the front center portion of the main mirror;

a right frame having a left side pivotally fixed to an outer right edge of the right sub mirror and having a right side pivotally fixed with a limited rotation angle to a portion of the cabinet adjacent to the main mirror so that the right frame and the right sub mirror are able to freely rotate in a horizontal direction providing a fully open state when said right sub mirror is facing outwardly in the front center portion of the main mirror;

a left coupling member provided on an inner right edge of the left sub mirror;

a right coupling member provided on an inner left edge of the right sub mirror;

wherein when both sub mirrors are in the fully open state, said coupling members are connected together providing a mirrored surface spaced in front of the main mirror, and wherein the limited rotation angle of the frames prevents the sub mirrors from rotating toward the main mirror, thereby preventing a back surface of the sub mirrors from contacting the main mirror.

2. A makeup mirror unit comprising:

a cabinet body;

a left sub mirror provided to substantially cover an outer left portion of the front surface of said cabinet body;

a main mirror provided to substantially cover a central portion of the front surface of said cabinet body;

a right sub mirror provided to substantially cover an outer right portion of the front surface of said cabinet body;

a left frame having a left side pivotally fixed to an outer left edge of the left sub mirror and having a right side pivotally fixed with a limited rotation angle to a portion of the cabinet adjacent to the main mirror so that the left frame and the left sub mirror are able to freely rotate in a horizontal direction providing a fully open state when said left sub mirror is facing outwardly in a front center portion of the main mirror;

a right frame having a left side pivotally fixed to an outer right edge of the right sub mirror and having a right side pivotally fixed with a limited rotation angle to a portion of the cabinet adjacent to the main mirror so that the right frame and the right sub mirror are able to freely rotate in the horizontal direction providing a fully open state when said right sub mirror is facing outwardly in a front center portion of the main mirror;

a left coupling member provided on an inner right edge of the left sub mirror;

a right coupling member provided on an inner left edge of the right sub mirror;

wherein when both sub mirrors are in the fully open state, said coupling members are connected together providing a mirrored surface spaced in front of the main mirror, and wherein the limited rotation angle of the frames prevents the sub mirrors from rotating toward the main mirror, thereby preventing a back surface of the sub mirrors from contacting the main mirror.

3. The makeup mirror unit according to claim 2, wherein the main mirror rotates.

4. The makeup mirror unit according to claim 1, wherein the width of the sub mirror is ½-⅔of the main mirror.

5. The makeup mirror unit according to claim 1, wherein the frame comprises a vertical member, and the vertical member is positioned at the end which is near to the rotation center of the sub mirror.

6. The makeup mirror unit according to claim 5, wherein the frame has a C shape comprising the vertical member, an upper horizontal member and a lower horizontal member.

7. The makeup mirror unit according to claim 1, wherein a hinge is provided for fixing the frame to the cabinet body so as to freely rotate, and the rotation axis of the hinge is located at a position of overlapping with the sub mirror in a closed state from a plan view or at a forward position thereto.

8. The makeup mirror unit according to claim 1, wherein a seat of a hinge for fixing the frame and the sub mirror is clamped to a back surface of the frame, and the other seat of the hinge is clamped to the back surface of the sub mirror.

9. The makeup mirror unit according to claim 1, wherein a seat of a hinge for fixing the frame and the sub mirror is integrally formed with the frame, and a seat of a hinge for fixing the frame to the cabinet body is integrally formed with the frame.

10. The makeup mirror unit according to claim 1, wherein a rack portion for small goods is provided in the back surface of the sub mirror, which utilizes the thickness of the frame.

* * * * *